US006976273B1

(12) United States Patent
Lewis et al.

(10) Patent No.: US 6,976,273 B1
(45) Date of Patent: Dec. 20, 2005

(54) PROTECTIVE GARMENT HAVING POCKET WITHIN POUCH

(75) Inventors: Patricia Lewis, Tipp City, OH (US); William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 0 days.

(21) Appl. No.: 10/894,987

(22) Filed: Jul. 20, 2004

(51) Int. Cl.[7] ..... A41D 3/02
(52) U.S. Cl. ..... 2/94
(58) Field of Search ..... 2/94, 102, 106, 2/115, 247, 250, 253, 79, 227, 69

(56) References Cited

U.S. PATENT DOCUMENTS 2,407,888 A * 9/1946 Lesser ..... 2/253
2,458,353 A * 1/1949 Decker ..... 2/250
2,967,307 A * 1/1961 O'Donnell ..... 2/253
4,637,075 A * 1/1987 Ingrisano et al. ..... 2/94
4,791,681 A * 12/1988 Dean ..... 2/106
5,195,187 A * 3/1993 Yang ..... 2/102
5,940,883 A * 8/1999 Daoust ..... 2/102

* cited by examiner

*Primary Examiner*—Tejash Patel
(74) *Attorney, Agent, or Firm*—Wood, Phillips, Katz, Clark & Mortimer

(57) ABSTRACT

A protective garment for a firefighter or for an emergency worker comprises a pocket, which is adapted to hold a telecommunications device, and a pouch, which contains the pocket and is adapted to hold a face mask, outside the pocket. The pouch has a first mouth, which when opened provides access to the pocket, and a second mouth, which when opened provides access to the pouch, outside the pocket. When the protective garment is being worn by a person standing erectly, the first mouth becomes an upper mouth and the second mouth becomes a lower mouth. Each mouth of the pouch has manually operable closures or a manually operable closure, such as a flap, which is securable to a wall of the pouch via a hook-and-loop closure and via a metal clasp, at the first mouth and such as a zippered closure at the second mouth.

6 Claims, 5 Drawing Sheets

60
10
22
34
40
70
32
20
30
12
100
50
36

60
10
22
34
80
40
12
30
32
20

40
60
12
32
30
20

PROTECTIVE GARMENT HAVING POCKET WITHIN POUCH

TECHNICAL FIELD OF THE INVENTION

This invention pertains to a protective garment, such as a protective coat or protective coveralls, for a firefighter or for an emergency worker.

BACKGROUND OF THE INVENTION

Commonly, a firefighter or an emergency worker wears a protective garment, such as a protective coat or protective coveralls, onto which is sewn an external pouch holding a face mask for a self-contained breathing apparatus (SCBA) and enabling the face mask to be readily removed, when the face mask is to be also worn. Commonly, moreover, the firefighter or emergency worker is provided with a telecommunications device, such as a two-way radio, which is clipped separately and externally onto the protective garment.

SUMMARY OF THE INVENTION

This invention provides, for a firefighter or for an emergency worker, a protective garment comprising a pocket, which is adapted to hold a first article, such as a telecommunications device, and comprising a pouch, which contains the pocket and which is adapted to hold a second article, such as a face mask for a self-contained breathing apparatus. The pocket has a mouth. The pouch has a first mouth, which is openable and closeable by a person wearing the protective garment and which when opened provides access to the pocket for insertion of the first article into the pocket, through the mouth of the pocket, and for removal of the first article from the pocket, through the mouth of the pocket. The pouch has a second mouth, which is openable and closeable by a person wearing the protective garment and which when opened provides access to the pouch, outside the pocket, for insertion of the second article into the pouch and for removal of the second article from the pouch.

Preferably, the first mouth becomes an upper mouth when the protective garment is being worn by a person standing erectly and the second mouth becomes a lower mouth when the protective garment is being worn by a person standing erectly. Preferably, the pouch has first closure means, by which the first mouth is openable and closeable by a person wearing the protective garment, and second closure means, by which the second mouth is openable and closeable by a person wearing the protective garment.

This invention also provides, for a firefighter or for an emergency worker, a protective ensemble comprising the protective garment described above, a telecommunications device, as the first article, and a face mask for a self-contained breathing apparatus, as the second article.

BRIEF DESCRIPTION OF THE DRAWINGS

FIGS. 1, 2, and 3 are similar views illustrating, fragmentarily, three different means for closing the pouch.

DETAILED DESCRIPTION OF THE ILLUSTRATED EMBODIMENT

Figure 1:
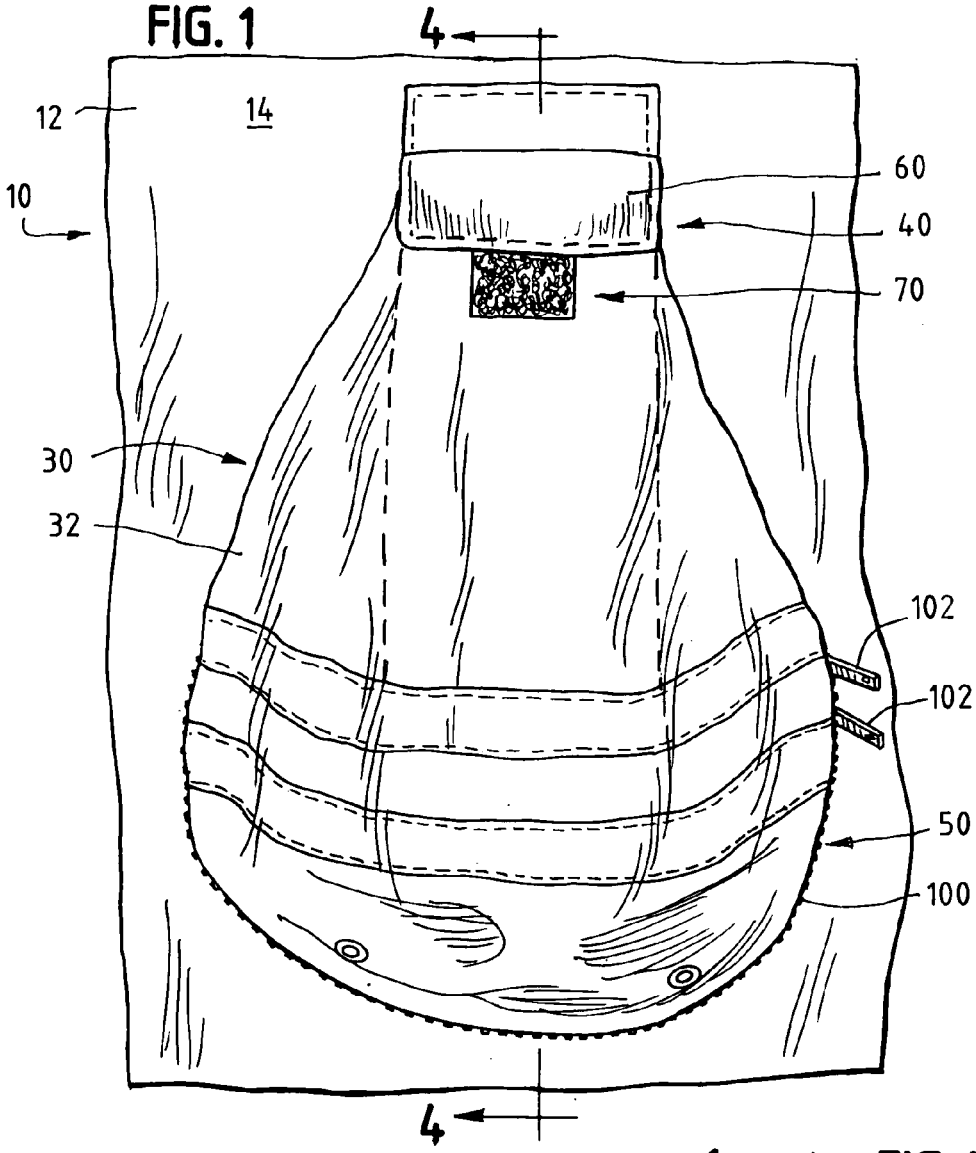
FIG. 1 is a front elevation illustrating, fragmentarily, an outer shell of a protective garment, such as a protective coat, and illustrating an outer pouch sewn to the outer shell.

As illustrated, a protective garment 10 for a firefighter or for an emergency worker has an outer shell 12, to an outer surface 14 of which is sewn a fabric pocket 20 and a fabric pouch 30 containing the pocket 20. The pouch 30 is defined by a fabric panel 32, which is sewn to the outer shell 12, and by the outer shell 12 where covered by the fabric panel 32. As illustrated, the protective garment 10 is a protective coat. Alternatively, the protective garment 10 is a suit of protective coveralls.

The pocket 20, which has an open mouth 22, is adapted to hold a telecommunications device 200, such as a mobile, two-way radio. The pouch 30, which has a first mouth 34 and a second mouth 36, is adapted to hold a face mask 300 for a self-contained breathing apparatus. The pouch 30 is adapted to hold the face mask 300, outside the pocket 20, whether or not the telecommunications device 200 is held by the pocket 20. When the protective garment 10 is worn by a person standing erectly, the open mouth 22 of the pocket 20 opens upwardly, the first mouth 32 of the pouch 30 becomes an upper mouth, which opens upwardly, and the second mouth 34 of the pouch 30 becomes a lower mouth, which opens downwardly.

The first mouth 32 is openable and closeable by a person wearing the protective garment 10 and, when opened, provides access to the pocket 20 for insertion of the telecommunications device 200 into the pocket 20, through the open mouth 22 of the pocket 20, and for removal of the telecommunications device 200 from the pocket 20, through the mouth 22 of the pocket 20. The second mouth 34 is openable and closeable by a person wearing the protective garment 10 and, when opened, provides access to the pouch 20, outside the pocket 20, for insertion of the face mask 300 into the pouch 30 and for removal of the face mask 300 from the pouch 30. The pouch 30 has first manually operable closure means 40, by which the first mouth 32 is openable and closeable by a person wearing the protective garment 10, and second manually operable closure means 50, by which the second mouth 34 is openable and closeable by a person wearing the protective garment 10.

In each illustrated embodiment, the first closure means 40 comprises a fabric flap 60, which is sewn to the outer shell 12 and which is adapted to be manually moved between a position where the first mouth 32 is closed by the flap 60 and positions where the first mouth 32 is not closed by the flap 60. When held releasably in the position where the first mouth 32 is closed by the fabric flap 52, the flap 60 provides lateral access for a flexible, electrical cable 210 connecting the telecommunications device 200 to an external microphone 220. Moreover, the flap 60 has two recesses 62 opening laterally, a selected one of which recesses 62 can provide access for a rod antenna 230 projecting vertically from the telecommunications device 200.

Figure 2:
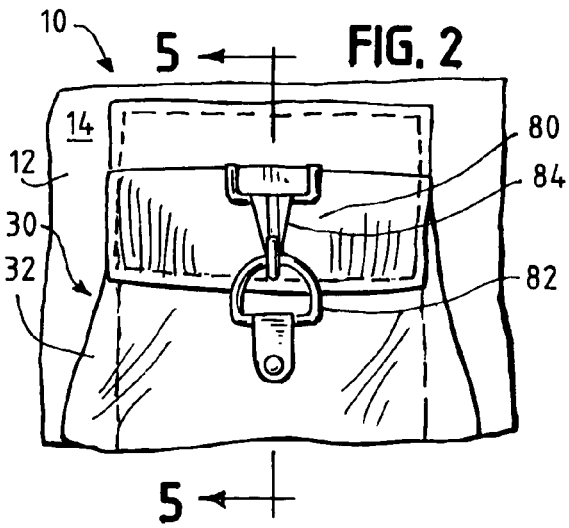
Figure 3:
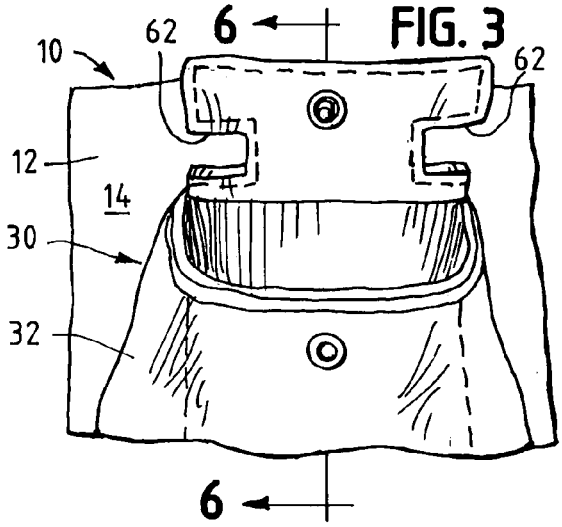
Figure 4:
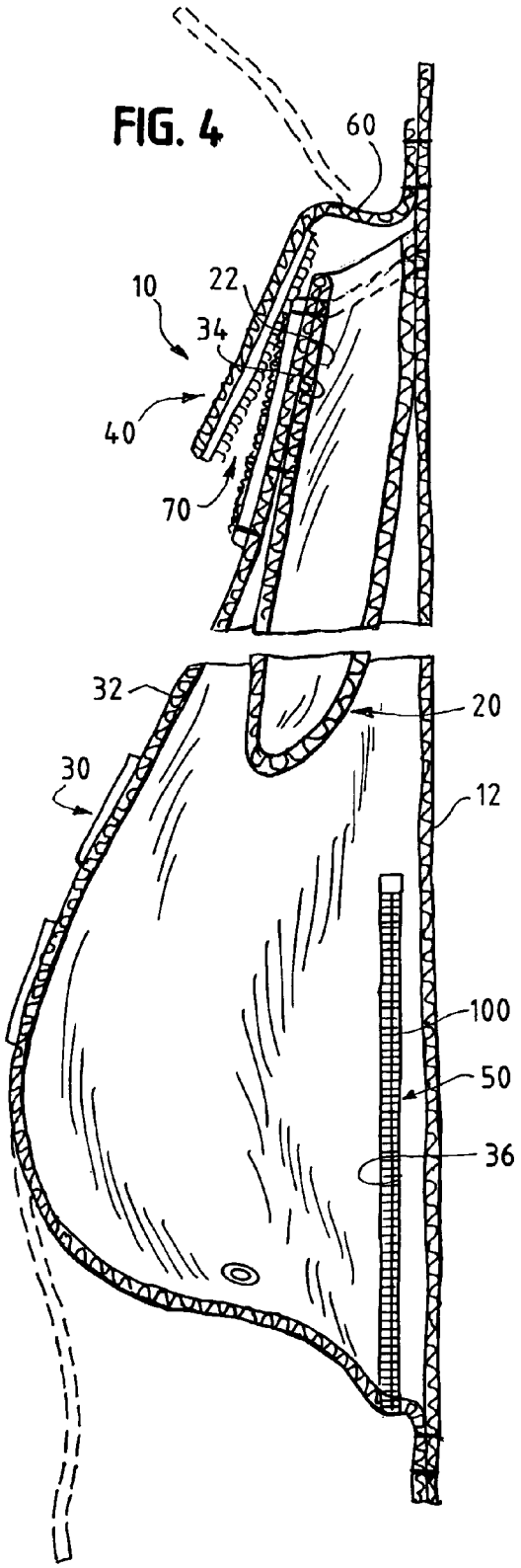
FIGS. 4, 5, and 6, respectively, are sectional views taken along lines 4—4, 5—5, and 6—6 in FIGS. 1, 2, and 3, respectively, and illustrating an inner pocket within the outer pouch.
Figure 5:
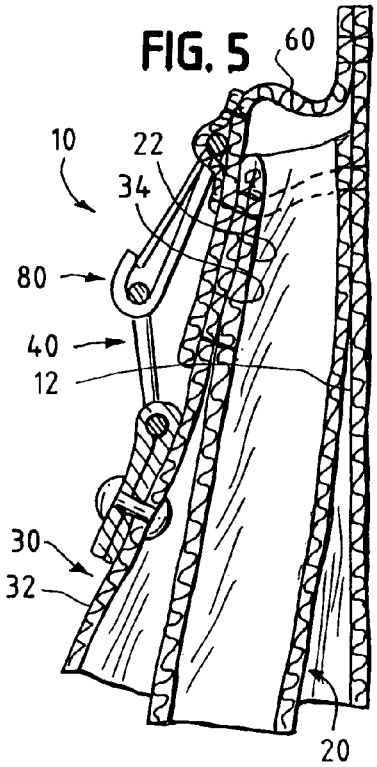
Figure 6:
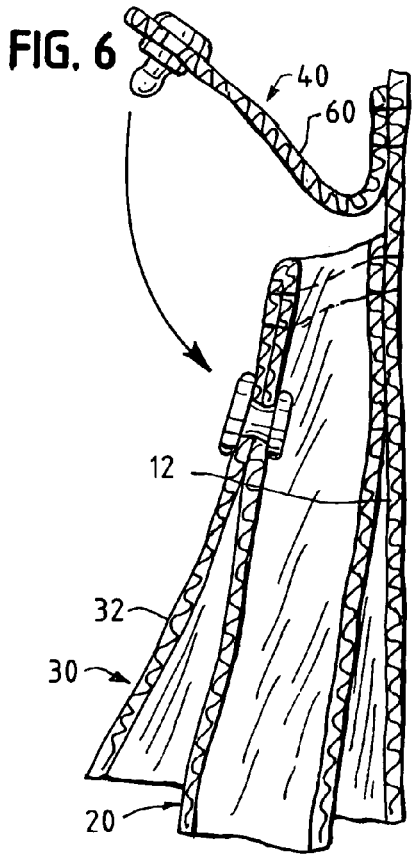
Figure 7:
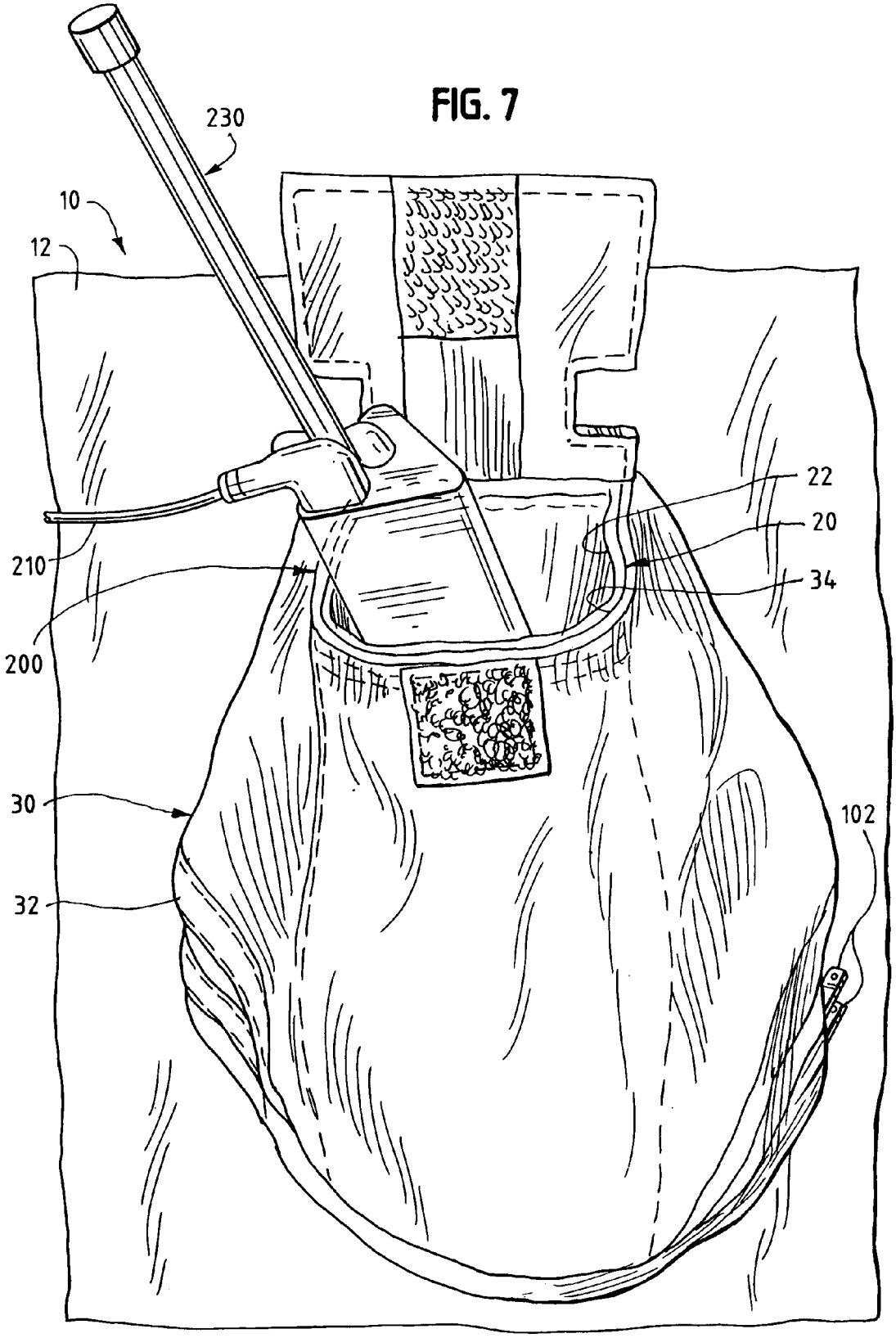
FIG. 7 is a front elevation illustrating, additionally, a telecommunications device being inserted into the inner pocket, through an upper mouth of the outer pouch and a near mouth of the inner pocket.
Figure 8:
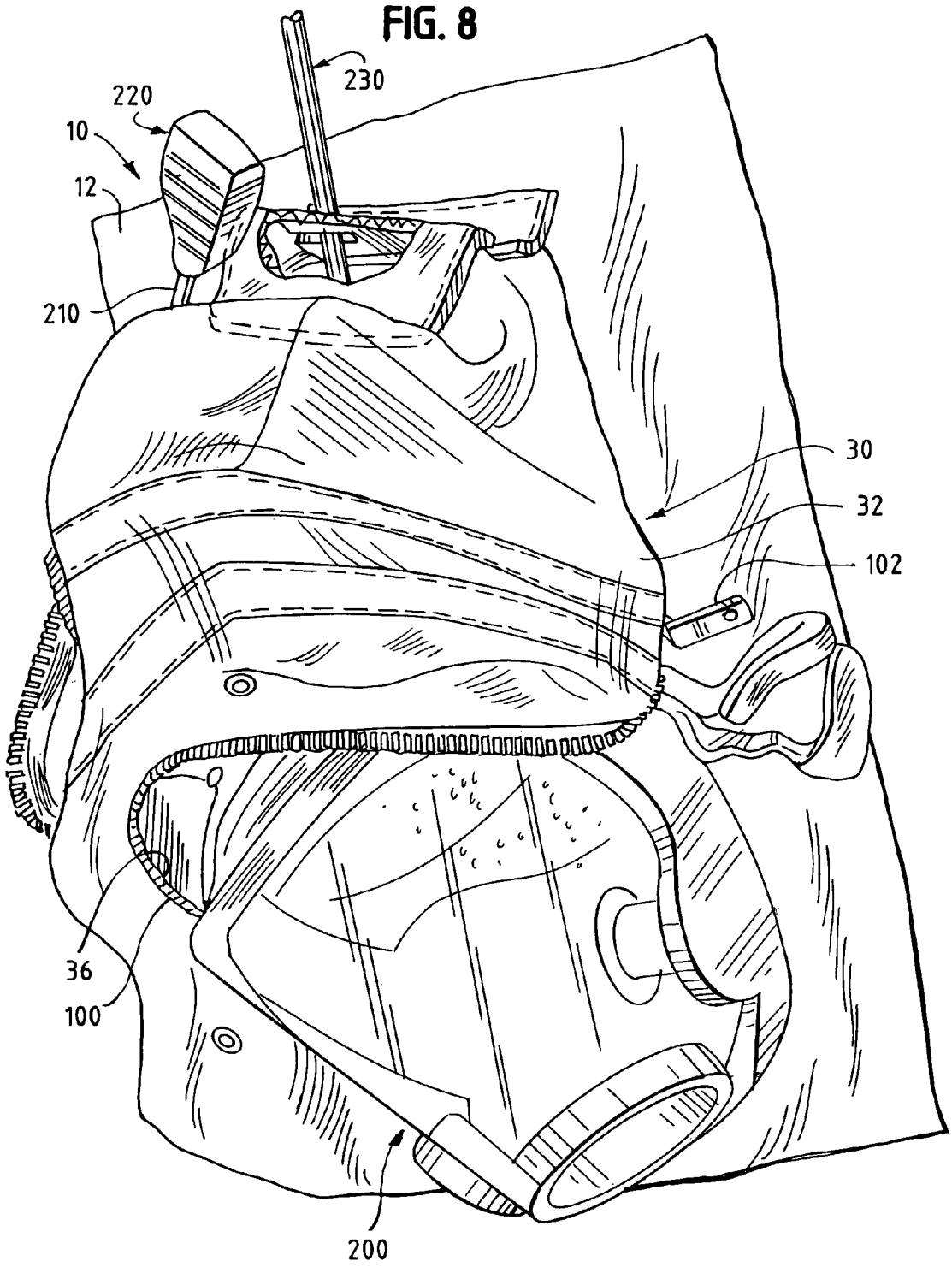
FIG. 8 is a front elevation illustrating a face mask being inserted into the outer pouch, through a lower mouth of the outer pouch.
Figure 9:
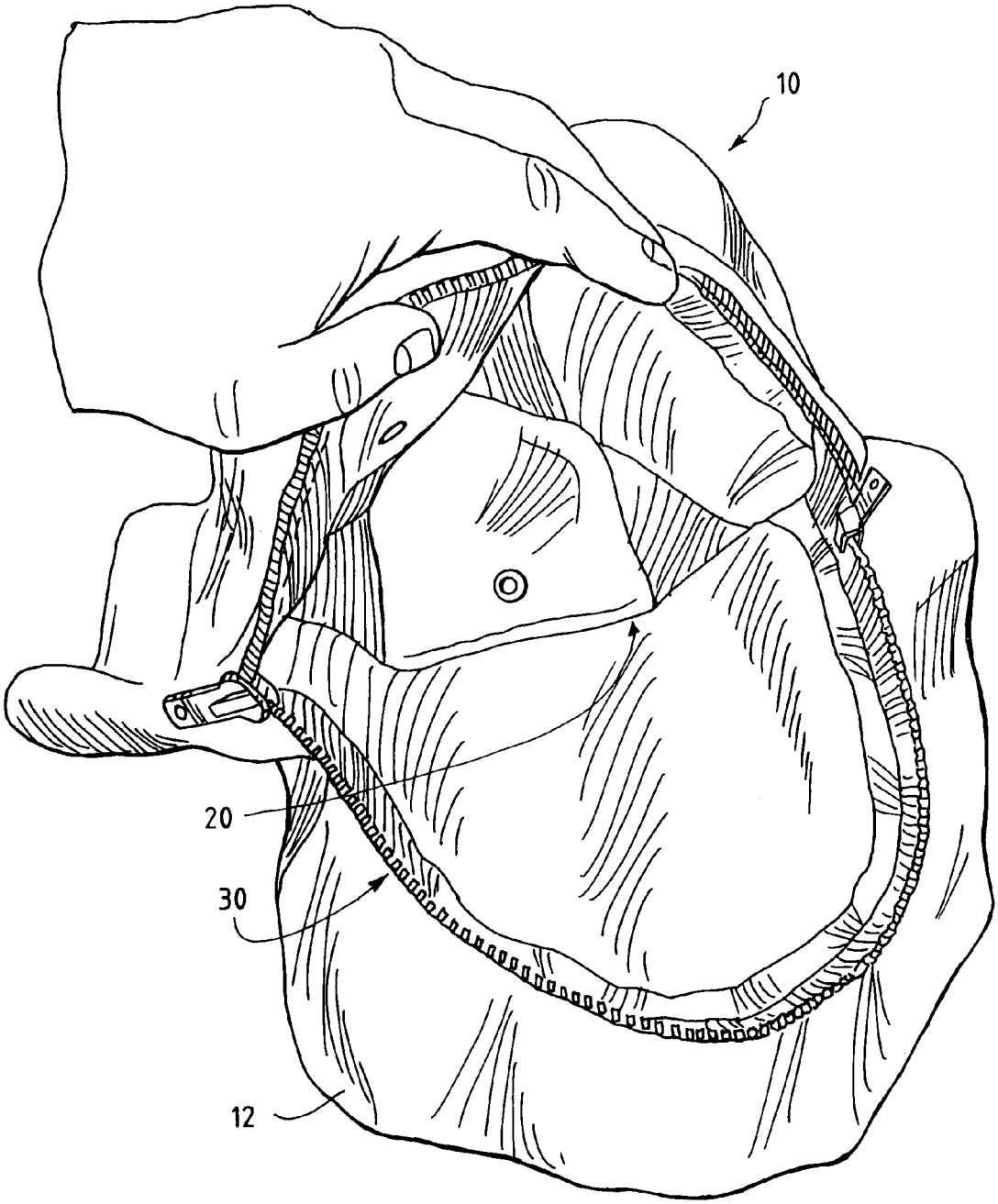
FIG. 9 is a front elevation illustrating the outer pouch, as seen through the lower mouth, without the face mask.

In a preferred embodiment illustrated in FIGS. 1 and 4, the first closure means 40 also comprises a hook-and-loop fastener 70 for holding the flap 60 releasably in the position where the first mouth 32 is closed by the flap 60. In an alternative embodiment illustrated in FIGS. 2 and 5, the first closure means 40 also comprises a mechanical clasp 80, which has a ring part 82 on the fabric panel 32 and a hook part 84 on the fabric flap 60 for securing the fabric flap 60 releasably in the position where the first mouth 32 is closed by the fabric flap 60. In an alternative embodiment illustrated in FIGS. 3 and 6, the first closure means 40 also comprises a snap fastener 90 for securing the fabric flap 60 releasably in the position where the first mouth 32 is closed by the flap 60. In each illustrated embodiment, the second closure means 50 comprises a mechanical zipper 100 having two zipper pulls 102.

Advantageously, when the telecommunications device 200 is being held in the pocket 20 and the fabric flap 52 is secured in the position where the first mouth 32 is closed by the fabric flap 52, the telecommunications device 200 is protected by the pouch 30, whether or not the face mask 300 is being held in the pouch 30.

What is claimed is:

1. For a firefighter or for an emergency worker, a protective garment comprising a pocket, which is adapted to hold a first article, and a pouch, which contains the pocket and is adapted to hold a second article, outside the pocket, whether or not the first article is held by the pocket, wherein the pocket has a mouth, wherein the pouch has a first mouth, which is openable and closeable by a person wearing the protective garment and which when opened provides access to the pocket for insertion of the first article into the pocket, through the mouth of the pocket, and for removal of the first article from the pocket, trough the mouth of the pocket, and wherein the pouch has a second mouth, which is openable and closeable by a person wearing the protective garment and which when opened provides access to the pouch, outside the pocket, for insertion of the second article into the pouch and for removal of the second article from the pouch, and wherein the first mouth becomes an upper mouth when the protective garment is being worn by a person standing erectly and wherein the second mouth becomes a lower mouth when the protective garment is being worn by a person standing erectly.

2. The protective garment of claim 1, wherein the pouch has first closure means, by which the first mouth is openable and closeable by a person wearing the protective garment, and second closure means, by which the second mouth is openable and closeable by a person wearing the protective garment.

3. For a firefighter or for an emergency worker, a protective garment comprising a pocket, which is adapted to hold a telecommunications device, and a pouch, which contains the pocket and is adapted to hold a face mask, outside the pocket, whether or not the telecommunications device is held by the pocket, wherein the pouch has a first mouth, which is openable and closeable by a person wearing the protective garment and which when opened provides access to the pocket for insertion of the telecommunications device into the pocket and for removal of the telecommunications device from the pocket, and a second mouth, which is openable and closeable by a person wearing the protective garment and which when opened provides access to the pouch, outside the pocket, for insertion of the face mask into the pouch and for removal of the face mask from the pouch, and wherein the first mouth becomes an upper mouth when the protective garment is being worn by a person standing erectly and wherein the second mouth becomes a lower mouth when the protective garment is being worn by a person standing erectly.

4. The protective garment of claim 3, wherein the pouch has first manually operable closure means, by which the first mouth is openable and closeable by a person wearing the protective garment, and second manually operable closure means, by which the second mouth is openable and closeable by a person wearing the protective garment.

5. For a firefighter or for an emergency worker, a protective ensemble comprising a telecommunications device, a face mask, and a protective garment comprising a pocket, which is adapted to hold the telecommunications device, and a pouch, which contains the pocket and is adapted to hold the face mask, outside the pocket, whether or not the telecommunications device is held by the pocket, wherein the pouch has a first mouth, which is openable and closeable by a person wearing the protective garment and which when opened provides access to the pocket for insertion of the telecommunications device into the pocket and for removal of the telecommunications device from the pocket, and a second mouth, which is openable and closeable by a person wearing the protective garment and which when opened provides access to the pouch, outside the pocket, for insertion of the face mask into the pouch and for removal of the face mask from the pouch, and wherein the first mouth becomes an upper mouth when the protective garment is being worn by a person standing erectly and wherein the second mouth becomes a lower mouth when the protective garment is being worn by a person standing erectly.

6. The protective ensemble of claim 5, wherein the pouch has first manually operable manually operable manually operable closure means, by which the first mouth is openable and closeable by a person wearing the protective garment, and second manually operable manually operable manually operable closure means, by which the second mouth is openable and closeable by a person wearing the protective garment.

* * * * *

UNITED STATES PATENT AND TRADEMARK OFFICE

CERTIFICATE OF CORRECTION

PATENT NO. : 6,976,273 B1
DATED : December 20, 2005
INVENTOR(S) : Lewis et al.

It is certified that error appears in the above-identified patent and that said Letters Patent is hereby corrected as shown below:

Column 3,
Line 33, "trough" should read -- through --.

Signed and Sealed this

Fourth Day of April, 2006

JON W. DUDAS
*Director of the United States Patent and Trademark Office*